US008702569B2

(12) United States Patent
Martin et al.

(10) Patent No.: US 8,702,569 B2
(45) Date of Patent: Apr. 22, 2014

(54) JAW STRENGTHENING DEVICE

(76) Inventors: Michael Martin, Irvine, CA (US); Gregory Martin, Irvine, CA (US)

( * ) Notice: Subject to any disclaimer, the term of this patent is extended or adjusted under 35 U.S.C. 154(b) by 524 days.

(21) Appl. No.: 13/100,095

(22) Filed: May 3, 2011

(65) Prior Publication Data

US 2012/0283069 A1 Nov. 8, 2012

(51) Int. Cl.
*A63B 23/03* (2006.01)

(52) U.S. Cl.
USPC ..... 482/11; 601/38; 482/122

(58) Field of Classification Search
USPC ..... 482/11, 121–122; 601/38
See application file for complete search history.

(56) References Cited

U.S. PATENT DOCUMENTS

| | | | | |
|---|---|---|---|---|
| 1,714,029 | A | 5/1929 | Kuhn | |
| 1,851,865 | A | 3/1932 | Ptacek | |
| 2,305,784 | A | 12/1942 | Horvath et al. | |
| 3,721,439 | A | 3/1973 | Rudolph et al. | |
| 3,738,651 | A * | 6/1973 | Norman et al. | 482/47 |
| 4,678,181 | A * | 7/1987 | Ditsch et al. | 482/47 |
| 5,582,560 | A | 12/1996 | Magnuson | |
| D418,560 | S * | 1/2000 | Hug | D21/684 |
| 6,524,262 | B1 | 2/2003 | Akihiro | |
| 7,238,145 | B2 | 7/2007 | Robbins et al. | |
| 7,438,667 | B2 | 10/2008 | Robbins et al. | |
| 7,476,180 | B1 | 1/2009 | Cobb | |
| 2007/0287598 | A1 | 12/2007 | Christensen, III | |

FOREIGN PATENT DOCUMENTS

| | | |
|---|---|---|
| JP | 405161681 | 6/1993 |

* cited by examiner

*Primary Examiner* — Stephen Crow
(74) *Attorney, Agent, or Firm* — Stetina Brunda Garred & Brucker

(57) ABSTRACT

A jaw strengthening device may have an upper mouthpiece and a lower mouthpiece. These mouthpieces may be attached to each other by way of a coil compression spring. This allows the upper and lower mouthpieces to shift front and back as well as laterally so that the upper and lower mouthpieces do not track a specific pivot point, but can follow the natural movement of the jaw. A film is wrapped around the spring and expands outwardly as the user bites down on the mouthpieces to push the inside surface of the person's cheek away from the coils of the spring and prevent the coils of the spring from pinching the user's cheek. Additionally, the device may be inserted inside the person's mouth so that the device is not aesthetically obtrusive.

12 Claims, 4 Drawing Sheets

JAW STRENGTHENING DEVICE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The embodiments disclosed herein relate to a device for strengthening muscles associated with a person's jaw.

Accidents may cause damage to a person's jaw. These accidents may occur during sports play, automobile accidents, etc. For example, a mixed martial art fighter may be punched or kicked in the jaw which could shatter the person's jaw. In this event, surgery and extensive physical therapy may be necessary in order to rehabilitate the jaw and the muscles associated with the jaw. Unfortunately, current devices for rehabilitating the jaw have certain deficiencies.

In particular, prior art devices typically have upper and lower mouthpieces that are spring loaded. The upper and lower mouth pieces of these devices have a defined path of travel. The defined path of travel may be an arc about a fixed pivot point or linear within a track. Unfortunately, these devices do not follow the natural movement of the jaw which may be non-circular and non-linear. Rather, the jaw movement must follow the defined path of the upper and lower mouth pieces of the prior art device.

U.S. Pat. Nos. 1,851,865 and 1,714,029 disclose prior art jaw exercising devices. Each of these devices have upper and lower mouth pieces which pivot relative to each other at a fixed pivot point. The upper and lower mouth pieces are held together by a leaf spring which provides resistance so that a person can bite down on the upper and lower mouth pieces to work the muscles of the jaw. Nonetheless, the upper and lower mouth pieces can only pivot about the pivot point defined by the leaf spring. The travel path of the upper and lower mouth pieces is fixed by the pivot point.

The device disclosed in U.S. Pat. No. 3,721,439 also has a defined travel path. In this case, the defined travel path is linear. The upper and lower mouth pieces are displaceable only along the guide bars.

A person's jaw does not pivot normally about a fixed pivot point. Moreover, the jaw of the person does not open and close in a linear fashion. Rather, the jaw movement of a person may be quite complex with forward to back movement and side to side movement.

These devices also extend out of the person's mouth and are aesthetically obtrusion or displeasing to look at. They are quite noticeable when the injured person is exercising his/her jaw muscles. As a result, the person may be less likely to work out his/her jaw muscles due to being self conscious.

Accordingly, there is a need in the art for an improved device.

BRIEF SUMMARY

The embodiments disclosed herein address the needs discussed above, discussed below and those that are known in the art.

The jaw strengthening device described herein comprises an upper mouthpiece and a lower mouthpiece. The upper and lower mouthpieces are received into the upper teeth and lower teeth of a person. One or more springs are attached to the upper and lower mouthpieces. Preferably, the springs are compression coiled springs and are disposed immediately below and above the upper and lower mouthpieces on its ends. The jaw strengthening device may be inserted into the person's mouth. The person may bite down on the upper and lower mouthpieces to compress the coil compression spring and work his/her jaw muscles. The upper and lower mouthpieces do not track a fixed pivot point. Rather, the coil compression spring enables the upper and lower mouthpieces to be displaced front and back and side to side while the person bites down on the upper and lower mouthpieces. The coil compression springs do not require that the upper and lower mouthpieces be compressed in a perfectly linear fashion so that movement of the upper and lower mouthpieces is not fixed to a pivot point or a linear track. Deviations from the axial direction are allowed. The coil compression springs are also surrounded by a film, which expands outwardly as the user bites down on the upper and lower mouthpieces. As the film expands outwardly, the film pushes against the inside surface of the person's cheek to prevent the coils of the coil compression springs from pinching the inside surface of the person's cheek. The coil compression springs are preferred since the coil compression springs provide a higher spring constant in a small package. During use the entire jaw strengthening device may be inserted into the person's mouth so that the device is not aesthetically obtrusive and displeasing to look at.

More particularly, a jaw strengthening device for rehabilitating one or more muscles associated with movement of a jaw is disclosed. The device may comprise an upper mouthpiece, a lower mouth piece and a spring. The upper mouthpiece may receive the upper teeth of the jaw. The lower mouthpiece may receive lower the teeth of the jaw. The spring may be disposed directly between the upper and lower mouthpieces. An upper end of the spring may be attached to the upper mouthpiece. A lower end of the spring may be attached to the lower mouthpiece to exercise the muscles associated with the jaw by biting down and loading the spring.

The spring may be a compression coil spring. The device may further include a flexible membrane wrapped around the compression coil spring. The flexible membrane may expand outward during a compression stroke of the spring to prevent an inside of a cheek from being pinched between coils of the spring.

The spring may be a straight, cylindrically shaped compression spring allowing for lateral movement and front to back movement to allow the upper and lower mouthpieces to track natural movement of the jaw. The straight, cylindrically shaped compression spring may be the sole hinge between the upper and lower mouthpieces. The spring may alternatively be a tapered spring to allow for a greater stroke compared to the straight cylindrically shaped compression spring.

Alternatively, the spring may be a disc spring or die spring. The device may further include a flexible membrane wrapped around the disc spring or die spring. The flexible membrane may expand outwardly during a compression stroke of the spring to prevent an inside of a cheek from being pinched between the disc springs or coils of the die spring.

Alternatively, the spring may be a urethane spring.

Two or more springs may be used and evenly distributed between the left and right sides of the upper and lower mouthpieces. To mount the springs, each of the upper and lower mouthpieces may have a plurality of spring mounts so that the spring(s) is selectively positionable in any one of the spring mounts.

In another embodiment, a jaw strengthening device for rehabilitating one or more muscles associated with movement of a jaw is disclosed. The device may comprise an upper mouthpiece, a lower mouthpiece, a coil compression spring, and a flexible membrane. The upper mouthpiece may receive upper teeth of the jaw. The lower mouthpiece may receive lower teeth of the jaw. The coil compression spring may be disposed between the upper and lower mouthpieces. An upper end of the spring may be attached to the upper mouthpiece. A lower end of the spring may be attached to the lower mouthpiece to exercise the muscles associated with the jaw by biting down and loading the spring. The flexible membrane may be wrapped around the compression coil spring. The flexible membrane may expand outwardly during a compression stroke of the spring to prevent an inside of a cheek from being pinched between coils of the spring.

In another embodiment, a method for rehabilitating one or more muscles associated with movement of a jaw is disclosed. The method may comprise the steps of inserting a jaw strengthening device into a mouth of a person with the entire device being disposed within the mouth of the person; aligning an upper mouthpiece to upper teeth of the person; aligning a lower mouthpiece to lower teeth of the person; compressing a compression coil spring which is disposed between the upper and lower mouthpieces to strengthen a jaw muscle of the person; decompressing the compression coil spring; and repeating the compressing and decompressing steps.

The method may further comprise the steps of removing the device from the mouth of the person; repositioning the spring; reinserting the jaw strengthening device into the mouth of the person with the entire device being disposed within the mouth of the person; realigning the upper mouthpiece to the upper teeth of the person; realigning the lower mouthpiece to the lower teeth of the person; and repeating the compressing and decompressing steps to strengthen a different jaw muscle of the person.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
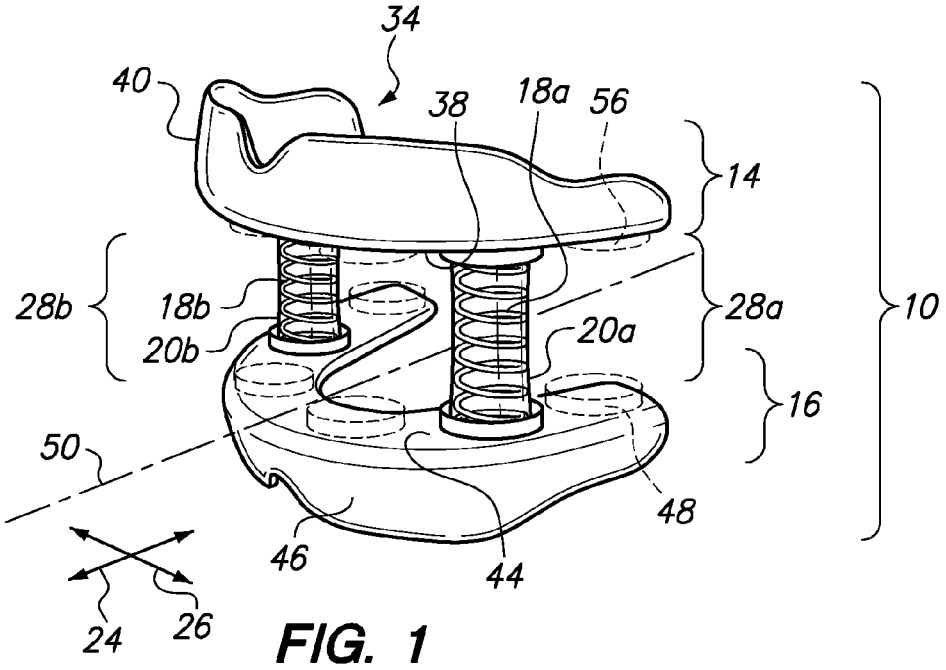
FIG. 1 is a perspective view of a jaw strengthening device.
Figure 2:
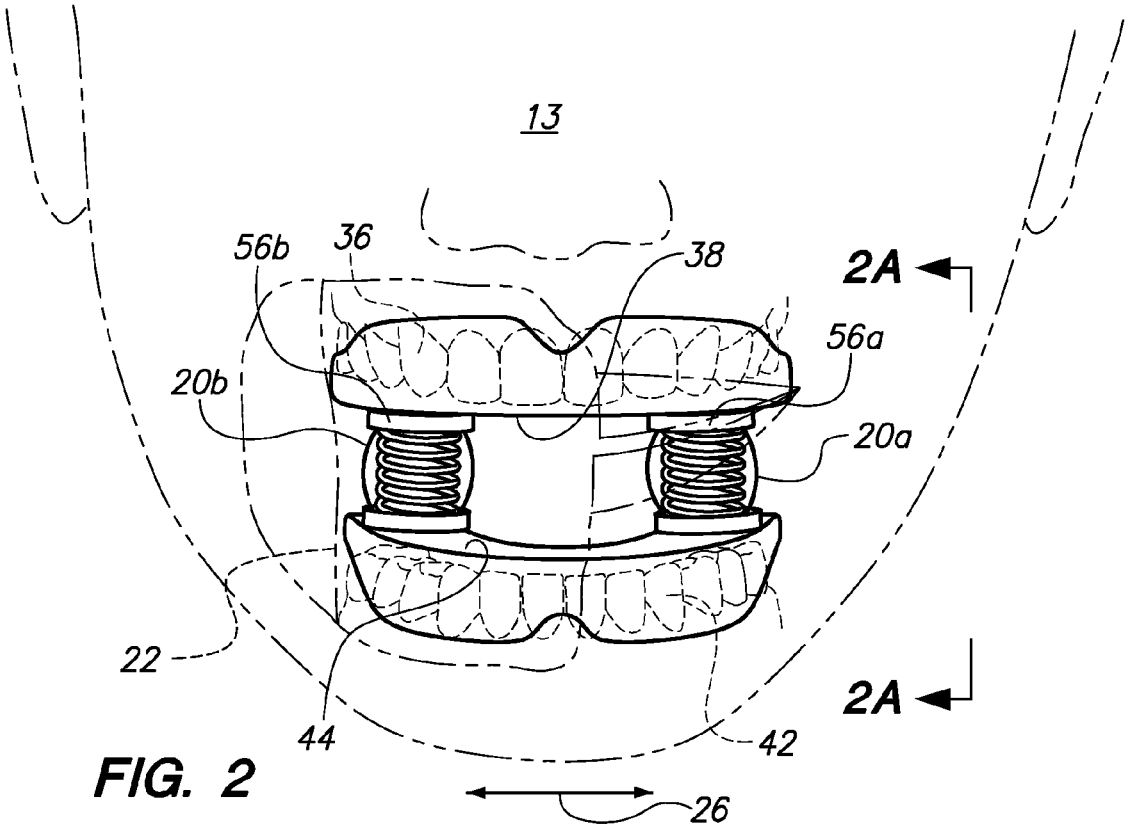
FIG. 2 is a front view of the jaw strengthening device shown in FIG. 1.

Referring now to the drawings, a jaw strengthening device 10 is shown. The jaw strengthening device 10 is used for the purpose of rehabilitating one or more muscles associated with the movement of a jaw 12 (see FIG. 2A) of a person 13. The device 10 may have an upper mouth piece 14 and a lower mouth piece 16 that are held together by springs 18*a, b*. The springs 18*a, b* may each be disposed within a flexible tube 20*a, b* that expands outwardly as shown in FIG. 2, to prevent a cheek 22 of a person 13 from being pinched between the coils of the springs 18*a, b*. Moreover, the upper and lower mouthpieces 14, 16 are not hinged together and not rotated about a fixed pivot point so that the upper and lower mouthpieces 14, 16 may track the natural movement of the jaw 12 as the muscles of the jaw 12 are exercised by opening and biting down on the upper and lower mouth pieces 14, 16. The coil springs 18*a, b* allow front to back motion of the mouth pieces 14, 16 in the direction of arrow 24 shown in FIGS. 1 and 2A as well as lateral movement shown by directional arrows 26, as shown in FIGS. 1 and 2. In this manner, the upper and lower mouthpieces 14, 16 can track the natural movement of the jaw 12. The jaw 12 does not have to track an artificial fixed pivot point that exists in prior art jaw strengthening devices.

Figure 4:
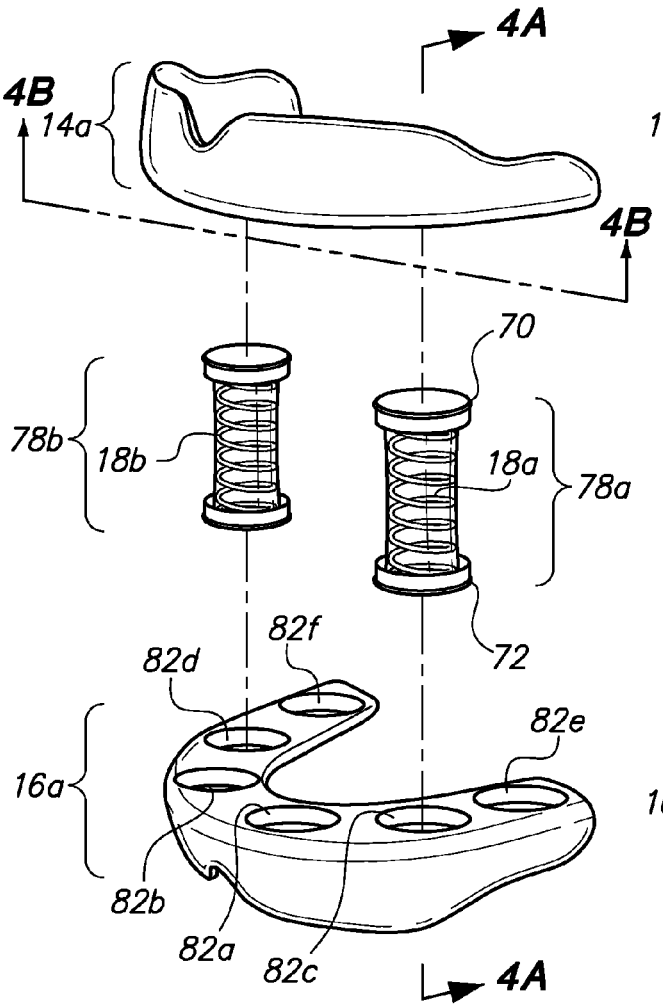
FIG. 4 is an exploded perspective view of a second embodiment of the jaw strengthening device.

The springs 18*a, b* may be positioned at different locations as shown in FIG. 4 between different upper and lower teeth of the person in order to work different muscles associated with the jaw 12. In particular, a spring assembly 78*a, b* can be removably installed into any one of a plurality of upper spring mounts 80*a-f* of the upper mouthpiece 14 and corresponding lower spring mounts 82*a-f* of the lower mouth piece 16. Moreover, the spring assemblies 78*a, b* may be provided with springs having different spring constants to provide different resistance. The spring assemblies 28 may be interchanged with each other.

More particularly, referring now to FIG. 1, the device 10 may comprise the upper and lower mouthpieces 14, 16. The upper mouth piece 14 may have a recess 34 for receiving the upper teeth 36 (see FIG. 2) of the person 13. The upper mouthpiece 14 may also have a flat base 38 (see FIGS. 1 and 2) and a front protective wall 40 which collectively define the groove 34. The upper teeth 36 bite down on the flat base 38 to compress the springs 18*a, b*. The springs 18*a, b* provide resistance and strengthen one or more of the muscles of the jaw of the person 13. The front wall 40 holds the upper mouthpiece 14 in place as the person 13 is working his/her jaw 12. Similarly, the lower mouthpiece 16 may have similar components compared to the upper mouth piece 14 but be sized and configured to receive the lower teeth 42 of the jaw 12. The lower mouthpiece 16 may also have a flat base 44 and a front wall 46 which functions similar to the flat base 38 and the front wall 40 of the upper mouthpiece 14. In particular, the flat base 44 of the lower mouthpiece 16 receives the lower teeth 42 of the person 13. The upper and lower mouth pieces may be configured similar to a typical generic molded sports mouth piece. When the person 13 bites down on the jaw strengthening device 10, the upper and lower teeth 36, 42 of the person 13 bite down on the flat base 38 of the upper mouthpiece 14 and the flat base 44 of the lower mouthpiece 16. Springs 18*a, b* provide resistance to strengthen the jaw muscles associated with the jaw 12. The front walls 40, 46 of the upper and lower mouthpieces 14, 16 retain the position of the device 10 within the person's mouth.

Figure 2A:
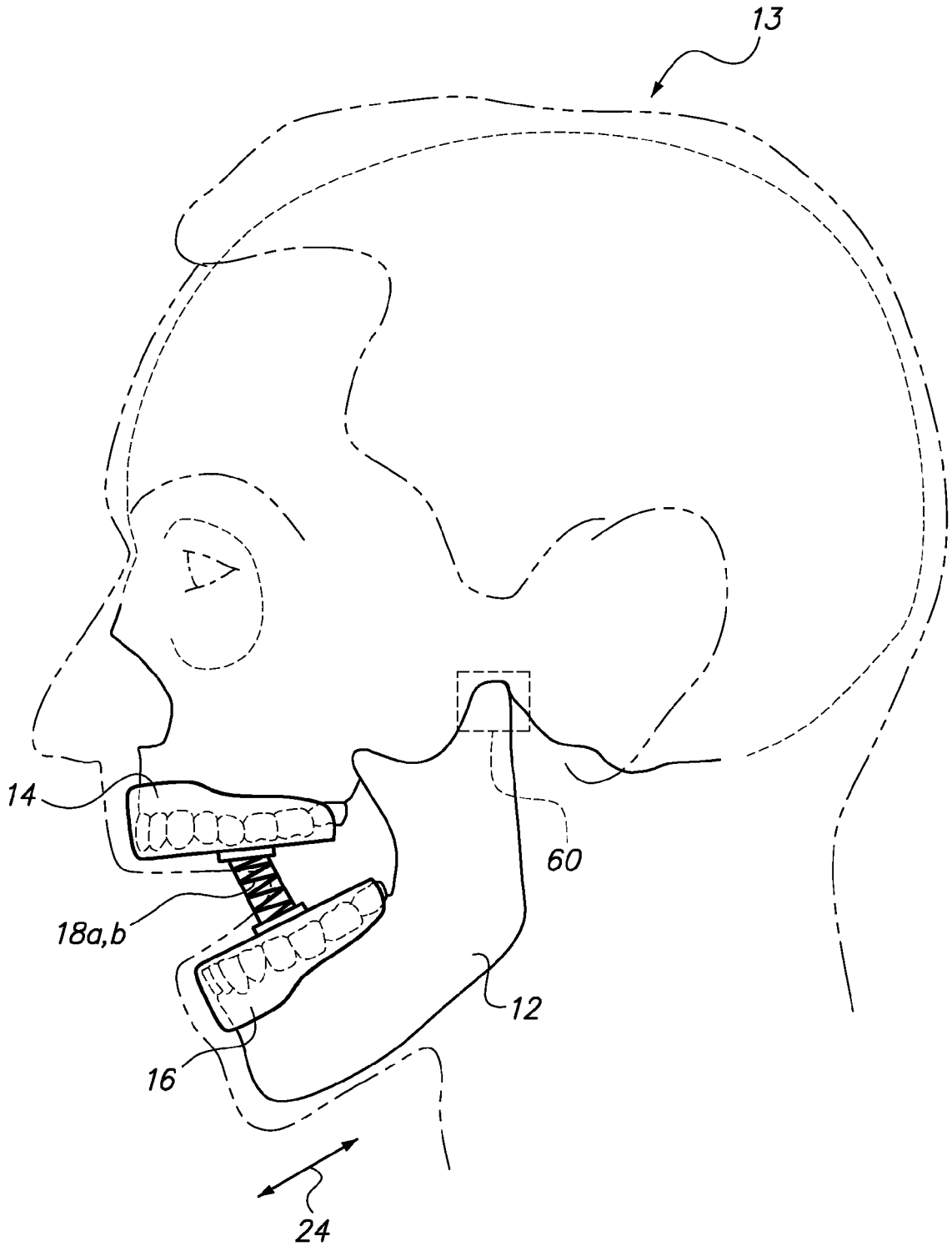
FIG. 2A is a side view of the jaw strengthening device shown in FIG. 2.

The upper and lower mouthpieces 14, 16 and the spring assemblies 28*a, b* may be inserted into the person's mouth so that the device is hidden within the person's mouth and not aesthetically obtrusive, as shown in FIGS. 2 and 2A.

Figure 3:
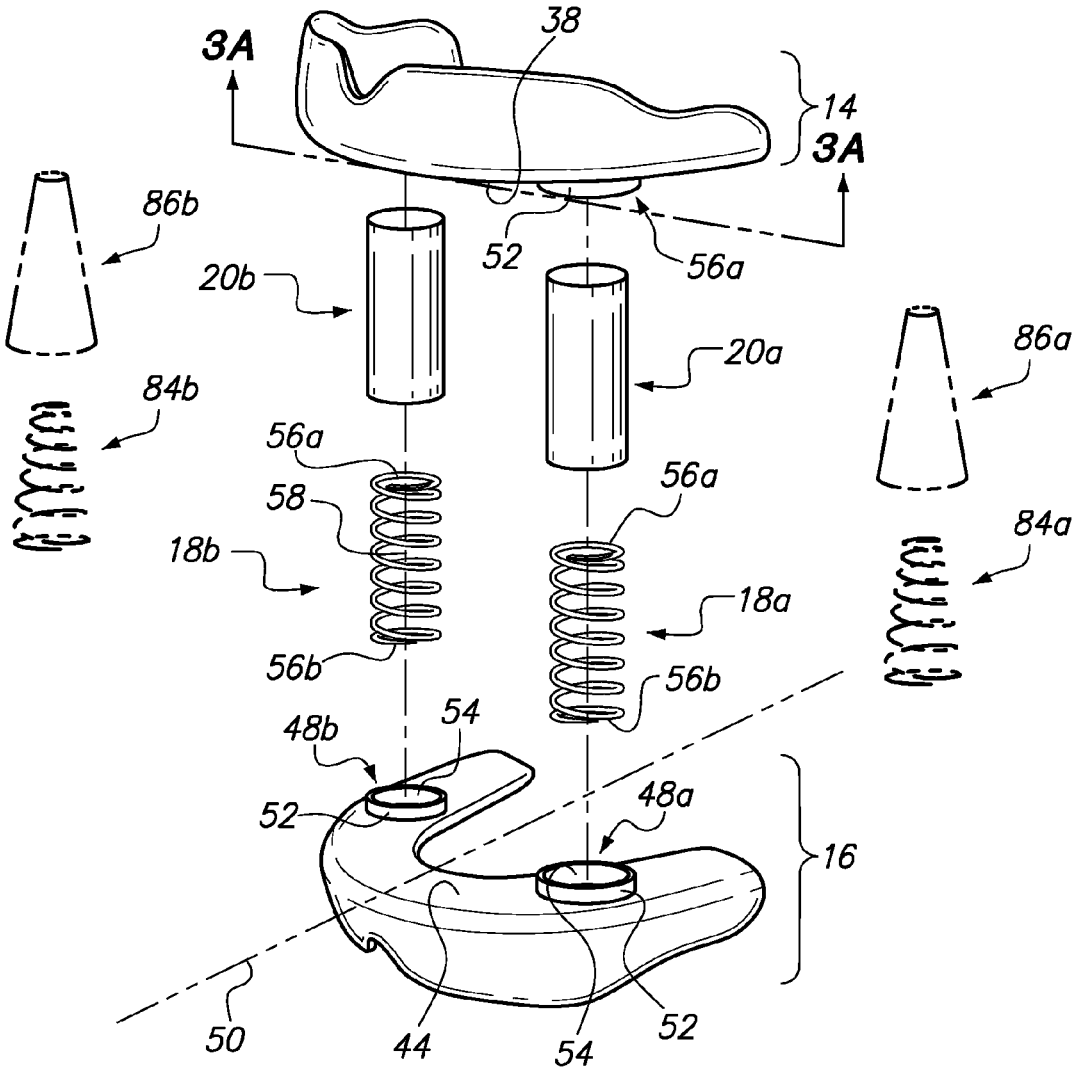
FIG. 3 is an exploded perspective view of the jaw strengthening device shown in FIG. 1.

Referring now to FIG. 3, the lower mouthpiece 16 may have two spring mounts 48*a, b* which are symmetrically located from a medial axis 50. The spring mounts 48*a, b* may be a cylindrical wall 52 having a central recess 54. The flat base 44 of the lower mouthpiece 16 may provide the lower surface of the spring mounts 40*a, b*. The springs 18*a, b* may be secured to the spring mounts 48*a, b* by any method known in the art or developed in the future. The springs 18*a, b* may define opposed distal ends 56*a, b*. The distal ends 56*a, b* of the springs 18*a, b* may be fitted within the spring mounts 48*a, b*. The springs 18*a, b* may have a friction fit with the cylindrical walls 52 of the spring mounts 48*a, b* to retain the springs 18*a, b* within the spring mounts 48*a, b*. The distal ends 56*b* of the springs 18*a, b* may also be adhered, welded or otherwise attached to the spring mounts 48*a, b* by methods known in the art or developed in the future. The upper mouthpiece 14 may have corresponding spring mounts 56*a,b* (see FIGS. 3 and 3A) placed at the same location as those spring mounts 48*a, b* of the lower mouthpiece 16. This allows the spring 18*a, b* to be disposed directly between the upper and lower mouthpieces 14, 16. As shown in FIG. 2A, the mounts may be positioned on the mouthpieces so that the springs 18*a, b* may be positioned between the first bicuspid and second bicuspid of the upper and lower row of teeth when the mouthpieces are worn by the user. It is also contemplated that mounts may be positioned at other locations so that the springs 18*a, b* may be positioned between other teeth of the upper and lower row of teeth. The spring mounts 56*a, b* of the upper mouthpiece 14 may be formed on the flat base 38. The distal ends 56*a* of the springs 18*a, b* may be attached to the spring mount 56*a* of the upper mouthpiece 14 such as by friction fit, adhesive, welding, and/or other methods known in the art or developed in the future.

The springs 18*a, b* may be coil compression springs (e.g., straight or tapered). Typically, the compression springs 18*a, b* are loaded uni-axially along the longitudinal central axis of the springs 18*a, b*. In particular, the coil compression springs 18*a, b* have a plurality of coils which are wrapped about its central axis 58 (see FIG. 3). The coil compression springs 18*a, b* are preferably loaded in a unidirectional direction. However, the coil compression springs 18*a, b* may also allow for front to back motion of the upper and lower mouth pieces 14, 16. Additionally, the coil compression springs 18*a, b* may also allow for the lateral movement (see arrow 26 in FIGS. 1 and 2). Movement of the upper and lower mouthpieces 14, 16 are not limited to a fixed pivot point between the two mouthpieces 14, 16 as in prior art devices. The coil compression springs 18*a, b* also provide an additional benefit of providing a large spring force in a compact size. The wires of the springs 18*a, b* may be round, square, rectangular or any other shape currently in use or developed in the future.

Referring to FIG. 2A, the jaw 12 of the person 13 generally moves about joint 60. However, the jaw 12 may have a complex motion in that the jaw 12 can be shifted to the front and back (direction 24) as well as laterally (direction 26) while pivoting about the joint 60. The springs 18*a, b* allow for such freedom of movement between the upper and lower mouthpieces 14, 16 so that the upper and lower mouthpieces 14, 16 can track the natural movement of the jaw 12 instead of being limited in its range of motion to a fixed pivot point as in prior art devices.

During use of the device 10, the coils of the springs 18*a, b* are brought closer to each other. Unfortunately, the inside surface of the person's 13 cheek 22 may be pinched between the coils of the springs 18*a, b* when the person 13 is biting down upon the jaw strengthening device 10. Fortunately, the films 20*a, b* expand outwardly, as shown in FIG. 2, to push the inside surface of the person's 13 cheek 22 away from the coils of the spring 18*a, b*. To this end, the films 20*a, b* and the cylindrical walls 52 of the spring mounts 48*a, b* and 56*a, b* may form an airtight seal or a semi airtight seal. When the upper and lower mouthpieces 14, 16 are brought closer to each other and the springs 18*a, b* are compressed, the films 20*a, b* may expand outwardly due to air pressure within the films 20*a, b* as shown in FIG. 2. There may also be a small also a slight leak to allow air to be released from within the films 20*a, b* to prevent over pressurizing the films 28*a, b* and bursting the same 28*a, b*. For example, the films 20*a, b* may form a semi-airtight seal with the cylindrical walls. Alternatively, the films 20*a, b* may have micro holes to allow for air to flow into and out of the films 20*a, b*.

The films 20*a, b* may have a tubular shape and be fabricated from a generally flexible membrane. The springs 18*a, b* may each be inserted into the tubular films 20*a, b*. The tubular films 20*a, b* may have a tight fit to a slightly loose fit over the spring 18*a, b*. The tubular films 20*a, b* may be about equal length or longer than the springs 18*a, b*. Once the springs 18*a, b* are inserted into the tubular films 20*a, b*, the springs 18*a, b* with the tubular films 20*a, b* are inserted into the spring mounts 48*a, b* and 56*a, b*. The springs 18*a, b* and the films 20*a, b* may be permanently attached to the spring mounts 48*a, b* and 56*a, b* with adhesive or other attachment methods known in the art or developed in the future. By way of example and not limitation, the adhesive may cover the inside surface of the spring mounts 48*a, b* and 56*a, b* and adhere the springs 18*a, b* and/or the films 20*a, b* to the spring mounts 48*a, b* and 56*a, b*. Alternatively, the springs 18*a, b* with films 20*a, b* may be temporarily attached to the spring mounts 48*a, b* and 56*a, b* via friction fit therebetween.

At a minimum, the tubular films 20*a, b* may expand outwardly so that the films 20*a, b* have a diameter greater than the outer diameter of the springs 18*a, b* so as to push the inside surface of the person's cheek away from the coils of the springs 18*a, b* and the coils of the springs 18*a, b* do not pinch the inside surface of the person's cheek during the compression stroke.

The films 20*a, b* may form an airtight seal with the spring mounts 48*a, b* and 56*a, b*. In this instance, the films 20*a, b* are designed to stretch and not break when the films 20*a, b* expands outwardly when the user bites down on the upper and lower mouth pieces. The films 20*a, b* stretch to prevent tearing of the films 20*a, b*. The films 20*a, b* may be fabricated from a non stretch material with a small hole to allow air to escape out of the films 20*a, b* as the films 20*a, b* expands outwardly and prevent tearing of the films 20*a, b*. In this instance, the films 20*a, b* may have a loose fit over the springs 18*a, b*.

To use the device 10 the person 13 inserts the entire jaw strengthening device 10 inside his/her mouth. The upper mouthpiece 14 is received by the upper teeth 36. The lower mouthpiece 16 is received by the lower teeth 42. To strengthen the muscles associated with the jaw 12 of the person 13, the user bites down on the jaw strengthening device 10. By biting down on the device 10, the upper and lower mouthpiece 14, 16 are brought closer to each other and the springs 18*a, b* are compressed. The compression of the springs 18*a, b* works the muscles of the jaw 12 of the person 13. As the person 13 bites down on the device 10, the films 28*a, b* may expand outwardly, as shown in FIG. 2. This pushes the inside surface of the person's 13 cheek 22 away from the coils of the spring 18*a, b*. In this manner, the inside surface of the person's cheek is not pinched between the coils of the springs 18*a, b*. When the user releases the device 10, the springs 18*a, b* push the upper and lower mouthpieces 14, 16 away, thereby decompressing the springs 18*a, b*. In order to strengthen the jaw 12 muscles, the person 13 cycles through a certain number of repetitions.

Figure 4A:
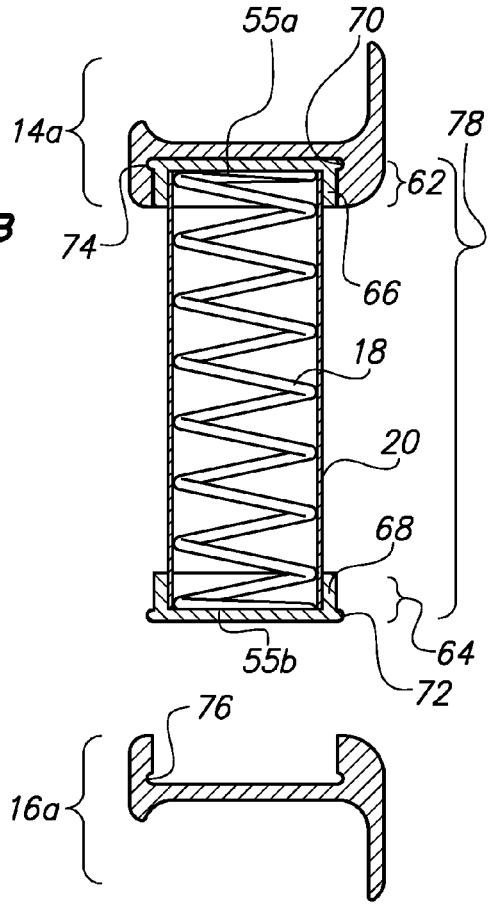
FIG. 4A is a cross sectional view of the jaw strengthening device shown in FIG. 4.
Figure 4B:
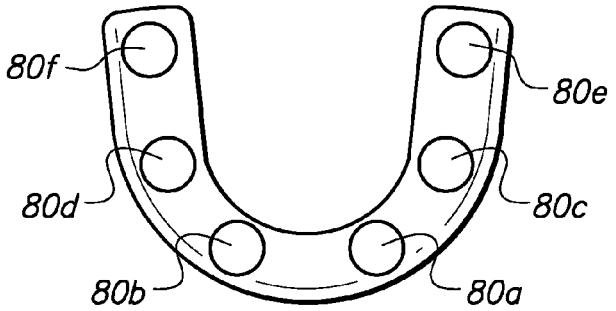
FIG. 4B is a bottom view of the upper mouthpiece of the jaw strengthening device shown in FIG. 4.

Referring now to FIGS. 4 and 4A, a second embodiment of the jaw strengthening device 10*a* is shown. In particular, the jaw strengthening device 10*a* may have spring assemblies 78*a, b*. The spring assemblies 78*a, b* are self contained units that allow the person 13 to position the spring assemblies 78*a,*

*b* at different locations on the upper and lower mouthpieces 14*a*, 16*a*. In particular, the upper and lower mouthpieces 14*a*, 16*a* have a plurality of spring mounts 80*a-f*, 82*a-f*. The spring assemblies 78*a, b* are removably attachable to any one of the spring mounts 80*a-f*, 82*a-f*. By way of example and not limitation, the spring assemblies 78*a, b* may be mounted to the spring mounts 80*a, b* 82*a, b*. Alternatively, the spring assemblies 78*a, b* may be mounted to spring mounts 80*c, d*, 82*c, d*. Furthermore, the spring assemblies 78*a, b* may be mounted to spring mounts 80*e,f*, 82*e, f*

Although only two spring assemblies 78*a, b* are shown and described, it is also contemplated that additional spring assemblies 78*n* may be mounted to the spring mounts 80*a-f*, 82*a-f* of the upper and lower mouthpieces 14*a*, 16*a*. Accordingly, there may be three or more spring assemblies 78*a-f* spread between the upper and lower mouthpieces 14*a*, 16*a*. This provides additional resistance and further strengthening of the person's jaw 12 by the device 10. Additionally, it is also contemplated that a plurality of spring assemblies 78*a-n* are provided. The plurality of spring assemblies 78*a-n* may have springs 18 with different spring constants. Based on the strength of the jaw 12 of person 13, the user may attach the appropriate spring assembly 78*a-n* to the upper and lower mouthpieces 14*a*, 16*a*.

The spring assembly 28 may be snapped into the upper and lower mouthpieces 14*a*, 16*a*. In particular, the spring assembly 28 (see FIG. 4A) may include the spring 18, film 20 and upper and lower end caps 62, 64. The upper and lower end caps 62, 64 receive the upper and lower ends 65*a, b* of the spring 18. The film 20 may have a tubular configuration and fit over the springs 18. The spring 18 and the tubular film 20 are disposed within the cylindrical wall 66 of the end caps 62, 64. The spring 18 and film 20 can have a friction fit with the end caps 62, 64 to hold the spring assemblies 28 as a unit so that the spring assembly 78 can be handled as a unit when the spring assembly 28 is removed from and inserted into different spring mounts 80, 82 of the upper and lower mouthpieces 14*a*, 16*a*. The end caps 62, 64 may additionally have ridges 70, 72 which circumscribe the end caps 62, 64 and are received into recesses 74, 76 formed in the flat bases 38, 44 of the upper and lower mouthpieces 14, 16. The ridges 70, 72 snap into and out of the recesses 74, 76 so that the spring assembly 28 can be removably attached to the upper and lower mouthpieces 14, 16.

Figure 3A:
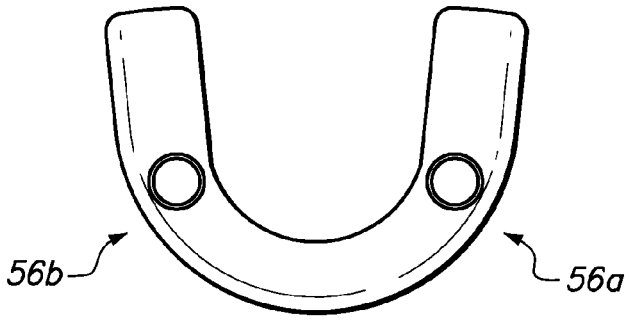
FIG. 3A is a bottom view of an upper mouthpiece of the jaw strengthening device shown in FIG. 3.

The springs 18*a, b* discussed herein are shown as being a coil compression spring; however, it is contemplated that the spring 18 may be a spiral spring such as a straight, cylindrically shaped coil compression spring, a die spring, a tapered spring and the like. The tapered springs allow for a greater compression stroke compared to straight coil compression springs. The spring may also be a urethane spring or a disc spring. An example of a tapered spring embodiment is shown in FIG. 3A in phantom. The tapered springs 84*a, b* replaces springs 18*a, b*. The films 20*a, b* may be replaced with tapered tubular films 86*a, b*. The springs 84*a, b* may be inserted within the films 86*a, b* and attached to the mounts 48*a, b*, 56. The tapered springs 84*a, b* have a narrow end and a wide end. The wide end may snugly fit within the mount 48*a, b*. The mounts 56 may be matched to the narrow end of the tapered springs 84*a, b*. The tapered springs 84*a, b* may be oriented narrow end up or narrow end down. If the narrow end of the tapered springs 84*a, b* is oriented downward, then the mounts 48*a, b* may be sized to snugly fit the narrow end of the tapered springs 84*a, b*. The tapered springs 84*a, b* and films 86*a, b* may be attached to the mounts 48*a, b* and 56 as discussed above in relation to springs 18*a, b*.

In the embodiments disclosed herein, two or more springs were disposed between the upper and lower mouth pieces. However, it is also contemplated that only one spring is disposed between the upper and lower mouth pieces. In this event, the spring mount may be aligned to the center of the upper and lower mouth pieces. The single spring is mounted to the center spring mounts of the upper and lower mouth pieces.

Referring back to FIG. 1, the embodiment shown in FIGS. 1-3A has been described as having only two springs 18*a, b* at a fixed position. However, it is also contemplated that the springs 18*a, b* and films 20*a, b* may be selectively positioned at different areas of the upper and lower mouth pieces so as to work different jaw muscles. As shown in FIG. 1, additionally spring mounts 56 and 48 may be formed on the upper and lower mouth pieces 14, 16. The springs 18*a, b* may be positioned at any one of the other spring mounts 48*a, b*, 56*a, b*. These spring mounts 48*a, b* and 56*a, b* may be distributed symmetrically about the medial axis 50 similar to the embodiment shown in FIG. 3.

The above description is given by way of example, and not limitation. Given the above disclosure, one skilled in the art could devise variations that are within the scope and spirit of the invention disclosed herein, including various ways of forming the upper and lower mouth pieces. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A jaw strengthening device for rehabilitating one or more muscles associated with movement of a jaw, the device comprising:

an upper mouthpiece which receives upper teeth of the jaw;

a lower mouthpiece which receives lower teeth of the jaw; and a spring disposed directly between the upper and lower mouthpieces with an upper end of the spring being attached to the upper mouthpiece and a lower end of the spring being attached to the lower mouthpiece to exercise the muscles associated with the jaw by biting down and loading the spring, wherein the spring is the sole hinge between the upper and lower mouthpieces.

2. The device of claim 1 wherein the spring is a compression coil spring and the device further includes a flexible membrane wrapped around the compression coil spring, the flexible membrane expands outwardly during a compression stroke of the spring to prevent an inside of a cheek from being pinched between coils of the spring.

3. The device of claim 1 wherein the spring is a straight, cylindrically shaped compression spring allowing for lateral movement to allow the upper and lower mouthpieces to track movement of the jaw.

4. The device of claim 1 wherein the spring is a spiral spring.

5. The device of claim 1 wherein the spring is a tapered spring.

6. The device of claim 1 wherein the spring is a disc spring or die spring and the device further includes a flexible membrane wrapped around the disc spring or die spring, the flexible membrane expands outwardly during a compression stroke of the spring to prevent an inside of a cheek from being pinched between the disc springs or coils of the die spring.

7. The device of claim 1 wherein the spring is a urethane spring.

8. The device of claim 1 comprising two or more springs evenly distributed between the left and right sides of the upper and lower mouthpieces.

9. The device of claim 1 wherein each of the upper and lower mouthpieces having a plurality of spring mounts so that the spring is selectively positionable in any one of the spring mounts.

10. A jaw strengthening device for rehabilitating one or more muscles associated with movement of a jaw, the device comprising:

an upper mouthpiece which receives upper teeth of the jaw;

a lower mouthpiece which receives lower teeth of the jaw;

a coil compression spring disposed between the upper and lower mouthpieces with an upper end of the spring being attached to the upper mouthpiece and a lower end of the spring being attached to the lower mouthpiece to exercise the muscles associated with the jaw by biting down and loading the spring; and a flexible membrane wrapped around the compression coil spring, the flexible membrane expands outwardly during a compression stroke of the spring to prevent an inside of a cheek from being pinched between coils of the spring.

11. A method for rehabilitating one or more muscles associated with movement of a jaw, the method comprising the steps of: providing a jaw strengthening device;

inserting the jaw strengthening device into a mouth of a person with the entire device being disposed within the mouth of the person;

aligning an upper mouthpiece to upper teeth of the person;

aligning a lower mouthpiece to lower teeth of the person;

compressing a compression coil spring which is disposed between the upper and lower mouthpieces to strengthen a jaw muscle of the person;

decompressing the compression coil spring; and repeating the compressing and decompressing steps.

12. The method of claim 11 further comprising the step of:

removing the device from the mouth of the person;

repositioning the spring; reinserting the jaw strengthening device into the mouth of the person with the entire device being disposed within the mouth of the person;

realigning the upper mouthpiece to the upper teeth of the person;

realigning the lower mouthpiece to the lower teeth of the person; and repeating the compressing and decompressing steps to strengthen a different jaw muscle of the person.

* * * * *